US007187881B2

(12) United States Patent
Tsujimura

(10) Patent No.: US 7,187,881 B2
(45) Date of Patent: Mar. 6, 2007

(54) IMAGE FORMING APPARATUS WITH HEATING UNIT CONTROL FUNCTION

(75) Inventor: Yoshihiro Tsujimura, Shizuoka-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/176,136

(22) Filed: Jul. 6, 2005

(65) Prior Publication Data

US 2007/0009273 A1 Jan. 11, 2007

(51) Int. Cl.
*G03G 15/20* (2006.01)

(52) U.S. Cl. ..... 399/69; 399/70; 219/216

(58) Field of Classification Search ..... 399/69
See application file for complete search history.

(56) References Cited

U.S. PATENT DOCUMENTS 6,008,829 A * 12/1999 Wakamiya et al. ..... 347/156

FOREIGN PATENT DOCUMENTS

| | | | |
|---|---|---|---|
| JP | 2003-156964 | | 11/2001 |
| JP | 2001310494 A | * | 11/2001 |
| JP | 2003-195680 | | 12/2001 |
| JP | 2004-70056 | | 8/2002 |

* cited by examiner

*Primary Examiner*—David M. Gray
*Assistant Examiner*—Bryan Ready
(74) *Attorney, Agent, or Firm*—SoCal IP Law Group LLP; Steven C. Sereboff; M. Kala Sarvaiya

(57) ABSTRACT

An image forming apparatus having a heating unit control function in accordance with the present invention energizes one of a plurality of heating units designated by a sequence counter to be energized, halts energize of the heating unit if the time counter finishes the count of the heating period assigned to the heating unit, and halts the energization of the heating unit when a target temperature is reached by the temperature of the heating unit or the object to be heated by this heating unit even before the count of the heating period is completed by the time counter, and therefore the operation of heating the heating unit is efficient.

15 Claims, 6 Drawing Sheets

IMAGE FORMING APPARATUS WITH HEATING UNIT CONTROL FUNCTION

BACKGROUND OF THE INVENTION

1. Field of the Invention

The present invention relates to an image forming apparatus having a function to control a heating unit for use in a fixing heat roller or the like.

2. Description of the Related Art

Fixing heat rollers are used to fix unfixed toner on a sheet in an image forming apparatus such as a copying machine or a printer which performs an electrophotographic process to generate an image on the sheet. A pair of such heat rollers, which are heated by heaters at a predetermined temperature, are vertically arranged in order to transport a sheet which is being heated and pinched therebetween under pressure. The heaters are provided for the respective heat rollers, and set to a temperature at which fixation process progresses. In the case where a plurality of heaters are temperature controlled, thermistors are provided for the respective heaters.

In this case, since the power consumption of a heater is large, the respective heaters are controlled in order not to concurrently turn on as described in Japanese Patent Published Application No. Hei 2000-70056 and Japanese Patent Published Application No. Hei 2003-195680. Namely, the peak power level is suppressed by controlling the heating period T of the respective heaters in order to successively change energization from one heater to the other.

In the case where a plurality of heaters are not turned on at the same time as described above, while one heater is turned on, the other heater is turned off. Because of this, a heater being turned off may not maintain the fixing temperature at a constant level. In addition to this, the heating operation is inefficient because, for example, even if one heater reaches a target temperature, the energization cannot be changed over to the other heater since the respective switching periods are fixed.

DETAILED DESCRIPTION OF THE INVENTION

Throughout this description, the embodiments and examples shown should be considered as exemplars, rather than limitations on the apparatus of the present invention.

In what follows, the embodiments of the present invention will be explained in detail with reference to the accompanying drawings.

Figure 1:
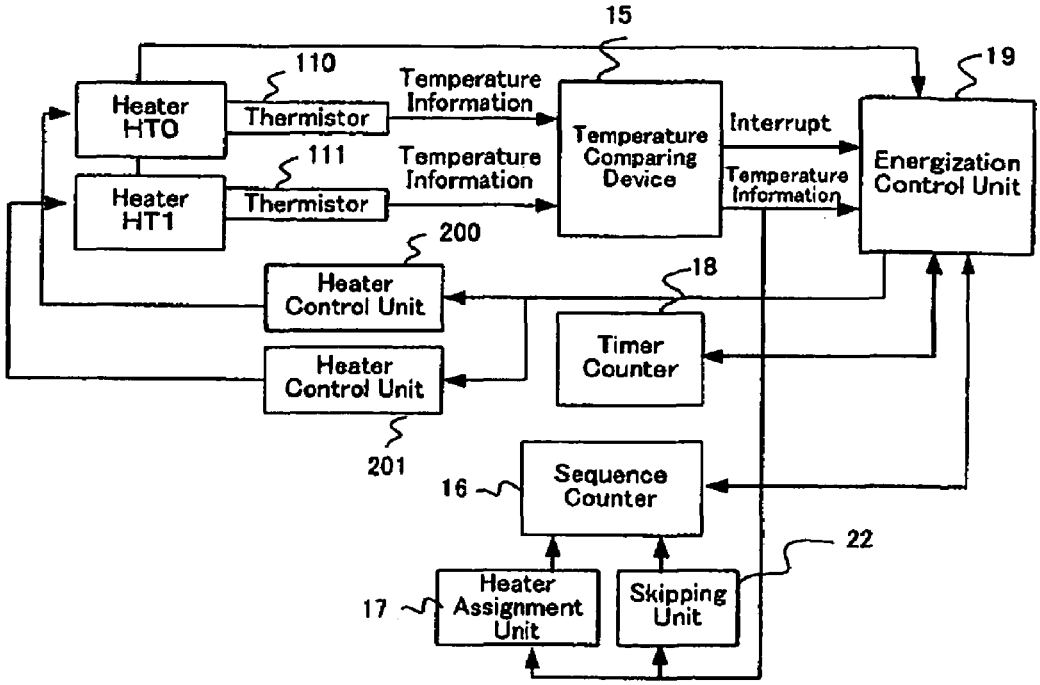
FIG. 1 is a functional block diagram showing a temperature control unit section of in accordance with a first embodiment of the present invention.

FIG. 1 is a functional block diagram to show a heater controlling section of an image forming apparatus having a heater control function in accordance with the first embodiment of the present invention. The image forming apparatus is provided with a pair of heat rollers for transporting a sheet which is being heated and fitted therebetween under pressure in order to fix unfixed toner on a sheet. Each of the heat rollers incorporates a heater. In this case, the heater can suitably take various forms as long as it is appropriate for heating the heat roller, and may be a heating unit which operates on the basis of induction heating. A plurality of heaters HT0 and HT1 as illustrated in FIG. 1 are used to heat such heat rollers, and turned on by energization to generate heat. The heaters HT0 and HT1 or the object to be heated (not shown in the figure) are provided with thermistors 110 and 111 as temperature sensors. In the following description, it is assumed that the temperature sensors are located near the heaters HT0 and HT1 in order to measure the temperatures of these heaters.

The reference 15 designates a temperature comparing device which sets target temperatures RT0 and RT1 for the respective heaters HT0 and HT1 and compares the target temperatures RT0 and RT1 to the heater temperatures TH0 and TH1 measured by the thermistors 110 and 111. Also, the temperature comparing device 15 serves to compare the heater temperatures TH0 and TH1 to each other. Then, temperature information and an interrupt signal are output as the result of comparison.

Namely, this sequence counter 16 sets the same number of sequence values "0" and "1" as there are the plurality of heaters HT0 and HT1, and successively outputs the plurality of sequence values "0" and "1" in an alternative manner by counter operation.

The heaters HT0 and HT1 are assigned respectively to the sequence values "0" and "1" by a heater assignment unit 17. For example, while the heater HT0 is assigned to the sequence value "0", the heater HT1 is assigned to the sequence value "1". The sequence counter 16 outputs the sequence value (for example, "0") to instruct an energization control unit 19 to be described below to supply an electric current to the heater HT0 assigned to the sequence value "0". Furthermore, when the energization of the heater HT0 corresponding to the sequence value "0" is finished, the sequence counter 16 outputs the next sequence value ("1" in this case).

The reference 18 indicates a time counter which starts counting the heating period of the heater HT0 or HT1 corresponding to the sequence value "0" or "1" as output from the sequence counter 16.

The energization control unit 19 serves to control the energization of the heater HT0 or HT1 through the corresponding one of heater control unit 200 and 201. Namely, the heater (for example, HT0 in this example) designated by the sequence counter 16 for the energization is energized by the corresponding heater control unit 200. Then, when the time counter 18 finishes the count of the heating period as set, the energization of the corresponding heater HT0 is halted. On the other hand, if it is detected by the temperature comparing device 15 that the temperature TH0 of the heater HT0 being energized reaches the target temperature RT0, a forcible switching function is executed to halt the energization of the corresponding heater HT0 even in the midst of counting the heating period by the time counter 18.

The heater assignment unit 17 serves to assign the control timings of the plurality of heaters HT0 and HT1 respectively to the sequence values "0" and "1" which are set in the sequence counter 16, and the criterion for assignment is based on the temperatures of the heaters at the time of assignment. Specifically, for example, the heater having the lower heater temperature is assigned to the sequence value "0" corresponding to the earlier output timing on the basis of temperature information as output from the temperature comparing device 15. Alternatively, the heater, whose heater temperature relative to the target temperature is lower, may be assigned to the sequence value "0" corresponding to the earlier output timing.

The reference 22 is a skipping unit which lets the sequence counter 16 skip the sequence value as sequentially output from the sequence counter 16. For example, when the energization of the heater HT0 is halted, the next sequence value "1" is output from the sequence counter 16. However, in this case, if the heater HT1 corresponding to this sequence value "1" has already reached the target temperature RT1 and need not be heated, the sequence value "1" is skipped to output the next sequence value "0".

The functionality of the respective units can be implemented within an ASIC or as the functions of the CPU which is used to control the whole operation of the image forming apparatus. Also, a software reset operation (hardware interruption of operation by controlling the values of registers) can be implemented by the use of the sequence counter, the time counter, a mode register (used for selecting the way of operation), and target temperature registers (used for storing the temperatures at which the respective heaters are turned on, and the temperatures at which the respective heaters are turned off). Furthermore, irrespective of the way of operation and so forth, there are two types of target temperature control registers and a plurality (two in this example) of timer registers, and the mode register is used to perform the changeover operation.

Next, the operation of this embodiment will be explained with reference to flowcharts of FIG. 2, FIG. 2A and FIG. 2B and a timing chart of FIG. 3.

Figure 2:
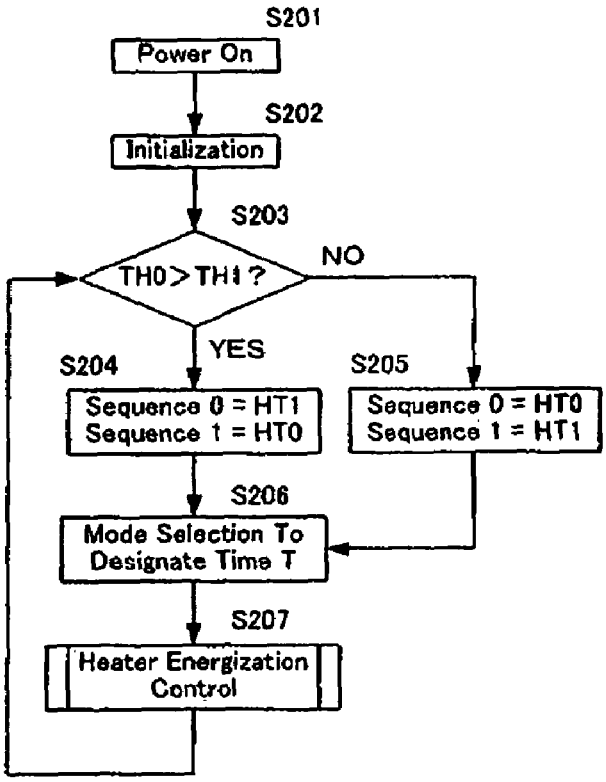
FIG. 2 is a flowchart showing the temperature control unit of in accordance with the first embodiment of the present invention.

In FIG. 2, when the power supply of the image forming apparatus is turned on (S201), the initial settings of the respective units are performed (S202).

Next, the temperature comparing device 15 compares the temperatures TH0 and TH1 of the heaters HT0 and HT1 as measured by the thermistors 110 and 111 (S203). Then, the heater assignment unit 17 assigns the heaters HT0 and HT1 to the sequence values "0" and "1" of the sequence counter 16 in appropriate pairings on the basis of this result of comparison (S204, S205).

In the case of the example shown in FIG. 2, if TH0>TH1 (S203: Y), the heater HT1 having the lower heater temperature is assigned to the sequence value "0" corresponding to the earlier output timing while the heater HT0 having the higher heater temperature is assigned to the sequence value "1" corresponding to the subsequent output timing (S204). Conversely, if TH0<TH1 (S203: N), the heater HT0 having the lower heater temperature is assigned to the sequence value "0" corresponding to the earlier output timing while the heater HT1 having the higher heater temperature is assigned to the sequence value "1" corresponding to the subsequent output timing (S205).

Next, while a control mode is selected, the heating periods T of the heaters HT0 and HT1 are determined (S206). Thereafter, the heaters HT0 and HT1 are turned on (energized) (S207).

In this case, while the heating periods of the heaters HT0 and HT1 are not necessarily the same value, it is assumed here that the heating periods of the heaters HT0 and HT1 are the same value T for the sake of clarity in explanation. Also, in accordance with the present invention, it should be noted that the heating period T is the maximum value of the period for which the respective heater is energized in one cycle, and that the energization of a heater can be halted before the heating period T elapses as will be described below.

Figure 3:
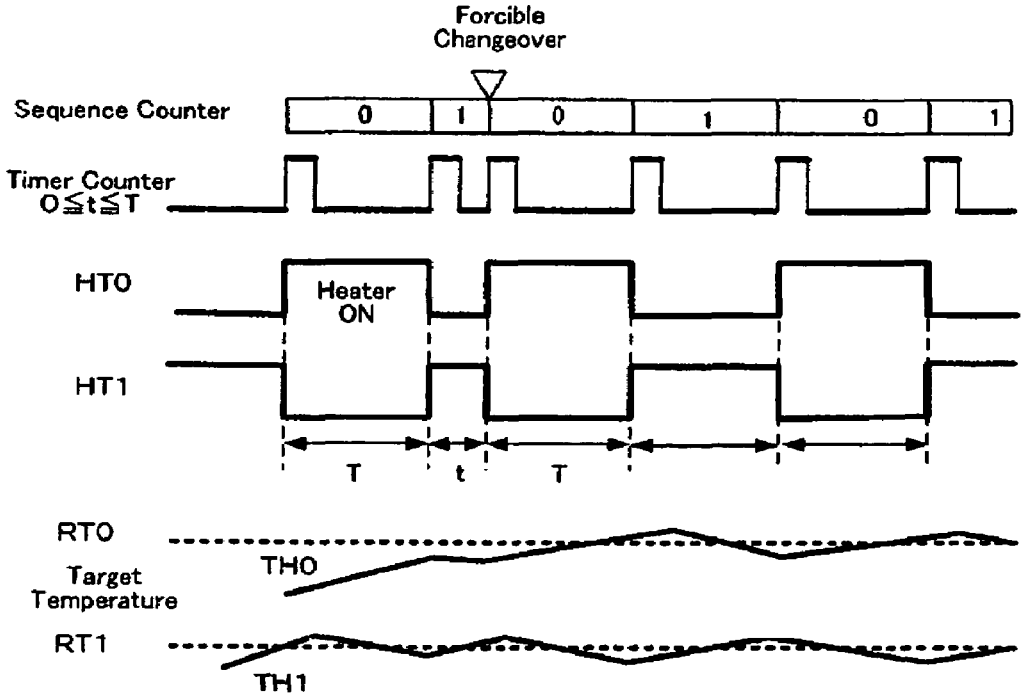
FIG. 3 is a timing chart for explaining the operation of the temperature control unit of in accordance with the first embodiment of the present invention.

FIG. 3 shows the image forming apparatus is in its stand-by state (ready to copy or print) in which these heaters HT0 and HT1 are controlled so that the temperatures TH0 and TH1 thereof is maintained near the target temperatures RT0 and RT1.

In a heater energization control step S207, at first, the heater corresponding to the sequence value "0" of the sequence counter 16 is turned on (energized). In this step, it is assumed that the temperature TH0 of the heater HT0 is lower than the temperature TH1 of the other heater HT1 as illustrated in FIG. 3 in advance of starting the sequence value "0". Accordingly, TH0<TH1 so that in step S205 the heater HT0 is assigned to the sequence value "0" and the heater HT1 is assigned to the sequence value "1".

Figure 2A:
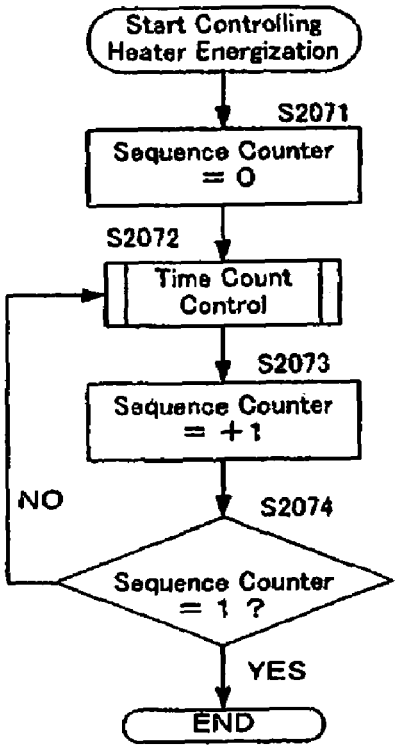
FIG. 2A is a flowchart for explaining the operation of the temperature control unit of FIG. 2 in detail.
Figure 2B:
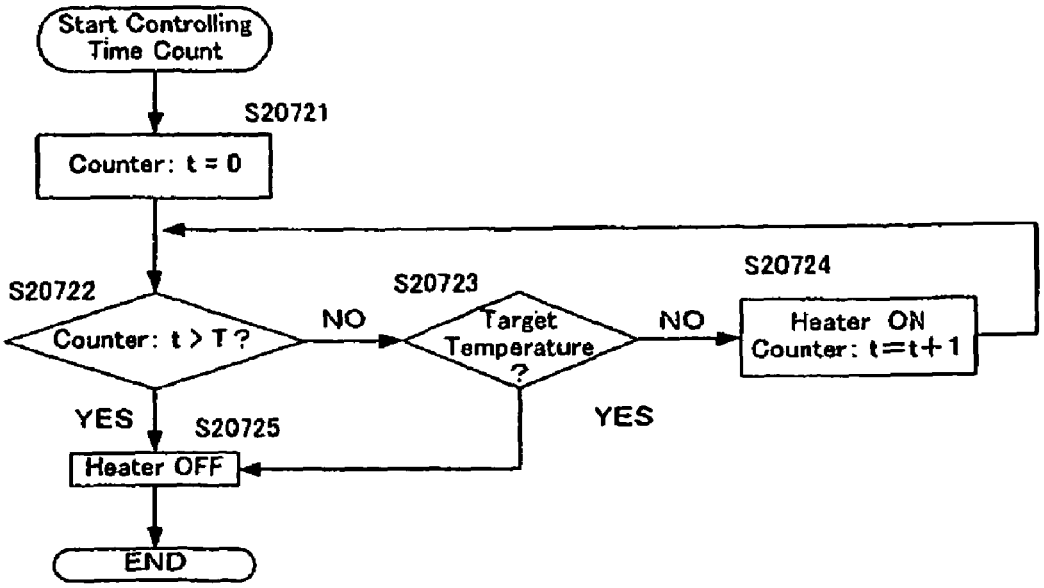
FIG. 2B is a flowchart for explaining the operation of the time count control step of FIG. 2 in detail.

As described above, since the heater HT0 is assigned to the sequence value "0" in the example shown in FIG. 3, the time counter 18 starts a time count control step (S2072) of the heating period assigned to the heater HT0 when the sequence counter 16 outputs the sequence value "0" (S2071) in the heater energization control process shown in FIG. 2A.

In the time count control step (S2072), the counter value is initialized as t=0 at the start of counting (S20721 in FIG. 2B), and since the counter value is smaller than the heating period T as designated (S20722: N), the result of comparison between the heater temperature TH0 and the target temperature RT0 output from the temperature comparing device 15 is evaluated (S20723). Because the count is just started, the heater temperature TH0 does not reach the target temperature RT0 (S20723: N), and therefore the heater HT0 is energized to turn on (generate heat) and the counter is incremented by one (S20724).

Thereafter, the counter value t is compared with the heating period T as designated (S20722), and if it does not reach the heating period T, the steps S20722 to S20724 are repeated to continue the energization of the heater HT0 until the heater temperature TH1 reaches the target temperature RT0 (S20723:Y) or the counter value t reaches the heating period T (S20722:Y).

In the exemplary case shown in FIG. 3, the temperature TH0 did not reach the target temperature RT0 as designated even after the energization of the heater HT0 was continued through the heating period T as designated corresponding to the first sequence value "0". In such a case, because the timer counter value t exceeds the heating period T as designated (S20722: Y), the energization of the heater HT0 is halted.

Thereafter, the sequence counter 16 counts up (S2073) so that the sequence value becomes "1" (S2074) to halt the heater energization corresponding to the sequence value "0". Thereafter, although not shown in the figure, the heater HT1 corresponding to the sequence value "1" is turned on (energized).

In this case, the heater HT1 corresponding to the sequence value "1" of the sequence counter 16 is turned on (energized) in the same manner as the heater HT0 corresponding to the sequence value "0". In the case of the example shown in FIG. 3, when the sequence counter 16 outputs the sequence value "1", the time counter 18 starts counting the heating period of the heater HT1. Since the temperature TH1 of the heater HT1 reaches the target temperature RT1 when the timer counter value=t before using up the heating period T as designated, as illustrated in FIG. 3, the energization of the heater HT1 is halted and the sequence counter 16 counts up to the next value "0", followed by terminating the process. Namely, if the temperature comparing device 15 detects that the temperature TH1 of the heater HT1 reaches the target temperature RT1 by the energization corresponding to the sequence value "1"; the energization of the corresponding heater HT1 is halted even when the time counter 18 is in the middle of counting before using up the heating period T as designated.

As has been discussed above, when the temperature TH1 of the heater HT1 reaches the target temperature RT1, the energization of the heater HT1 is halted to change over to the next sequence value even when the time counter 18 is in the middle of counting, and therefore it is possible to avoid a wasted heater-off state and perform an effective heater energization control, unlike the conventional technique in which the control does not change over to the next sequence value until the count of the heating period is completed.

The sequence counter 16 serves to successively count up the sequence value "0" or "1" to repeat the count cycle "0" and "1" after each count cycle consisting of "0" and "1" is finished. The heater energization control step (S207) is finished in each count cycle of "0" and "1" by the sequence counter 16, followed by evaluating the temperature relation of the heaters HT0 and HT1 again (S203). Since TH0<TH1 even at the start of the second count cycle of "0" and "1" in the case of the example of FIG. 3, in step S205 again, the heater "HT0" is assigned to the sequence value "0", and the heater HT1 is assigned to the sequence value "1", followed by repeating the heater energization control step (S207).

Figure 4:
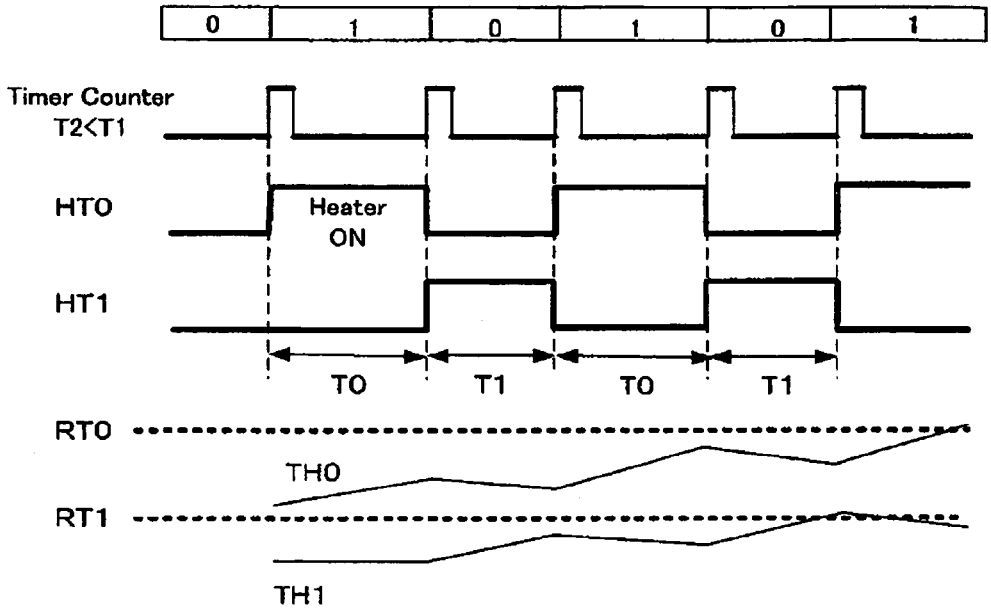
FIG. 4 is a timing chart for explaining the operation of the temperature control unit of in accordance with the first embodiment of the present invention in advance of transition to the stand-by state thereof.

While the same value T is assigned to the heating periods of the two heaters HT0 and HT1 as counted up by the time counter 18 in the case of the above embodiment, it is possible to set different heating periods in accordance with the temperature elevation characteristics of the respective heaters HT0 and HT1 in relation to the energization thereof as illustrated in FIG. 4. This setting can be made by the above mode register. In the example as illustrated in FIG. 4, since the heater temperatures TH0 and TH1 are substantially lower than the respective target temperatures RT0 and RT1, the heaters are heated in order to change over to the stand-by state as described above, for example, just after powering up the image forming apparatus or in a power saving mode.

In the example as illustrated in FIG. 4, since the ratio of the temperature elevation to the energization of the heater HT0 is smaller than that of the other heater HT1, the heating period T0 of the heater HT0 is set to be longer than the heating period T1 of the other heater HT1. By this configuration, the heaters HT0 and HT1 reach the target temperatures RT0 and RT1 nearly at the same time so that an efficient operation is possible.

Figure 5:
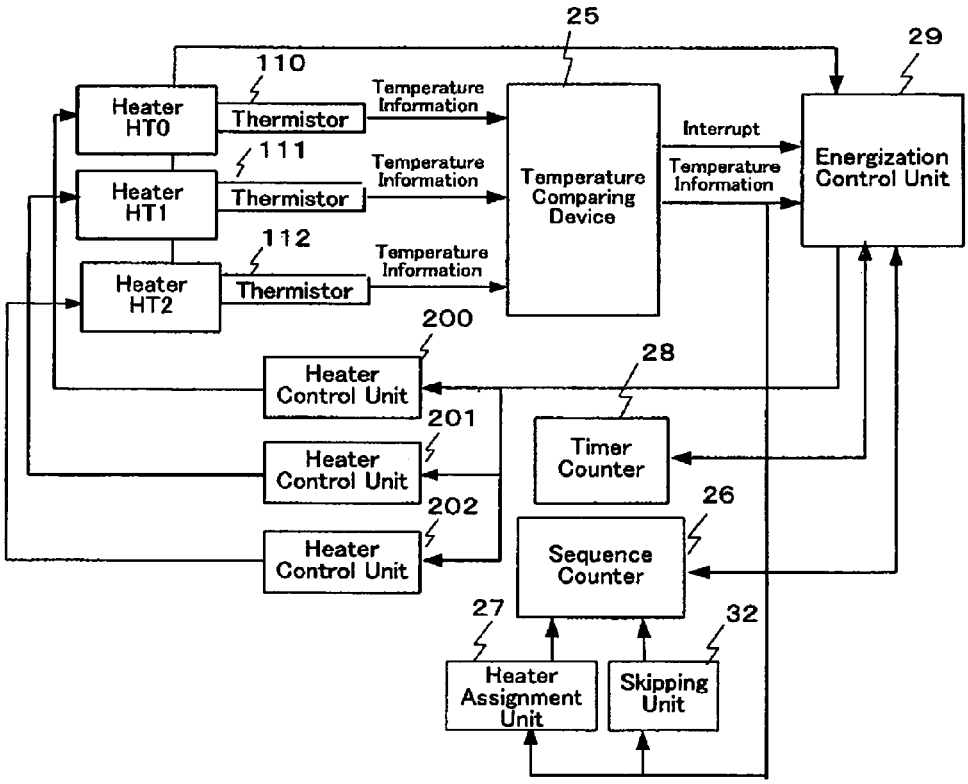
FIG. 5 is a functional block diagram showing a temperature control unit section of in accordance with a second embodiment of the present invention.

While the two heaters HT0 and HT1 are controlled in the case of the above embodiment, it is possible to control three heaters HT0, HT1 and HT2 as illustrated in FIG. 5.

In this case, the third heater HT2 is provided with a thermistor 112 for measuring the temperature thereof, and the temperature TH2 as measured is input to a temperature comparing device 25 together with the measured temperatures TH0 and TH1 of the other thermistors 110 and 111. This temperature comparing device 25 is used to set target temperatures RT0, RT1 and RT2 for the respective heaters HT0, HT1 and HT2, and compare the target temperatures RT0, RT1 and RT2 to the heater temperatures TH0, TH1 and TH2 as measured by the thermistors 110, 111 and 112. Also, the heater temperatures TH0 and TH1 are compared also to each other.

Furthermore, the sequence values "0", "1" and "2" corresponding to the three heaters HT0, HT1 and HT2 are set in the sequence counter 26, and repeatedly output in a successive and alternative manner, so that the heaters HT0, HT1 and HT2 are sequence controlled by the sequence values "0", "1" and "2". Namely, the heaters HT0, HT1 and HT2 are assigned respectively to the sequence values "0", "1" and "2" by a heater assigning unit 27.

The time counter 28 starts counting the heating period of the heater HT0, HT1 or HT2 corresponding to the sequence value "0", "1" or "2" as output from the sequence counter 26.

The energization control unit 29 controls the energization of the heater HT0, HT1 or HT2 designated by the sequence counter 26 for energization, through the corresponding one of heater control unit 200, 201 or 202.

The control timings of the plurality of heaters HT0, HT1 and HT2 are assigned respectively to the sequence value "0", "1" and "2", which are set in the sequence counter 26, by the heater assigning unit 27. The criterion for assignment is based on the temperature relation among the respective heaters.

The skipping unit 32 serves to skip the sequence value successively output from the sequence counter 26 in accordance with the temperature state of the heater corresponding to the next sequence value.

In what follows, the action will be explained with reference to the timing chart shown in FIG. 6. Incidentally, in FIG. 6, the ON states (energization conditions) of the heaters HT0, HT1 and HT2 are indicated by an L level. Also, the result of comparison between the heater temperatures TH0 and TH1 takes an L level if TH0>TH1, otherwise takes an H level. Furthermore, when the heater temperature TH0, TH1 or TH2 rises to or beyond the target temperature, it is represented by an H level, and conversely when the heater temperature are below the target temperature, it is represented by an L level.

Figure 6:
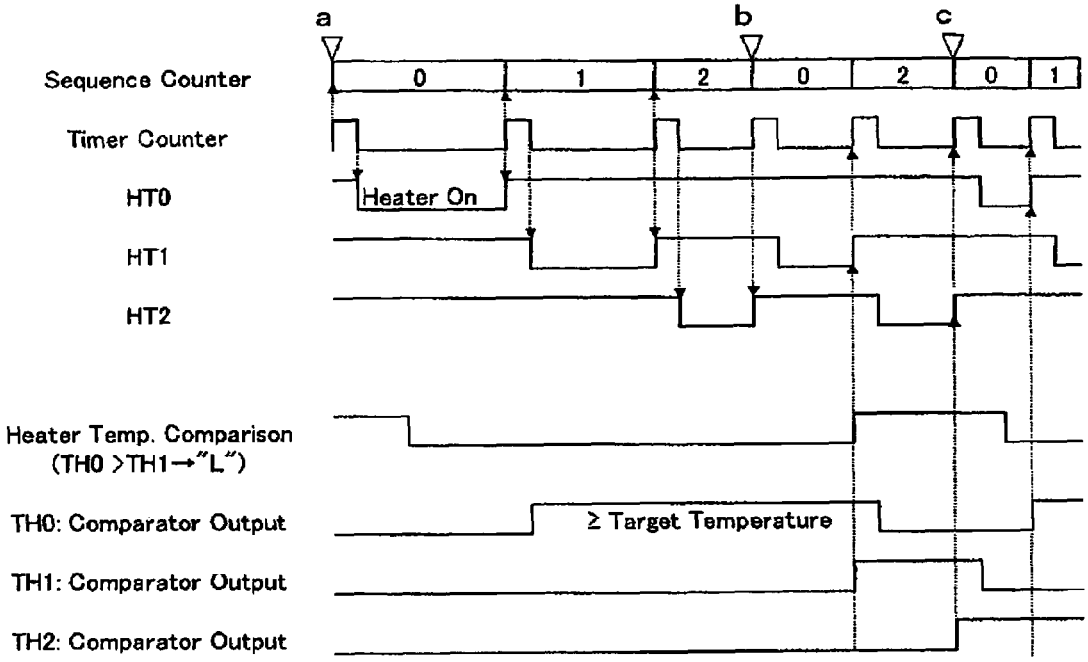
FIG. 6 is a timing chart for explaining the operation of the temperature control unit of in accordance with the first embodiment of the present invention.

In FIG. 6, the sequence counter 26 shown in FIG. 5 successively counts up as "0", "1", "2". At the start point "a" of the first count cycle, since the result of comparison between the heater temperatures TH0 and TH1 indicates that the heater temperature TH0 is lower (the temperature comparison result is an H level), the respective heaters HT0, HT1 and HT2 are assigned to the respective sequence values "0", "1" and "2" in the following way.

"0"=HT0, "1"=HT1 and "2"=HT2. Meanwhile, in this case, the heater HT2 is assigned always to the sequence value "2" irrespective of the result of comparison between the heater temperature TH2 and the heater temperatures TH0 and TH1.

Because of this, the respective the heaters HT0, HT1 and HT2 are controlled to be successively turned on as the sequence counter 26 counts up. In the first cycle of counting up, none of the heater temperatures TH0, TH1 and TH2 reaches the corresponding target temperature in the corresponding heating period, the energization is continued until the count of the heating period assigned thereto is completed. Of these heater temperatures, only the temperature TH0 of the heater HT0 is reached after the sequence value changes over "1".

At the start point "b" of the second count cycle, the heater temperatures TH0 and TH1 are compared to each other again, and since the heater temperature TH0 is higher (the temperature comparison result is an L level), the heaters HT0, HT1 and HT2 are assigned to the respective sequence values "0", "1" and "2" as "0"=HT1, "1"=HT0 and "2"=HT2.

Because of this, in the second count cycle, the heater HT1 is turned on in response to the output of the sequence value "0". The heater temperature TH1 rises by this energization. Since the temperatures of the respective heaters rise in the first energization cycle, the target temperatures are reached relatively early in the second energization cycle. In the case of the example shown in FIG. 6, the heater temperature TH1 reaches before the heating period as designated elapses, and the heater HT1 is turned off before the count of the heating period is completed. Because of this, the actual heating period of the heater HT1 is shorter than the heating period in the first energization cycle.

The sequence counter 26 is then to output the next sequence value "1" after completing the energization of the heater HT1 corresponding to the sequence value "0". However, the heater HT0 assigned to the sequence value "1" has already been heated to or beyond the target temperature by the previous energization. Because of this, the sequence value "1" is skipped by the skipping unit 32 shown in FIG. 5, and instead the next sequence value "2" is output. Then, the heater HT2 assigned to the sequence value "2" is turned on, and the energization is halted when the temperature TH2 thereof is elevated to or beyond the target temperature.

At the start point "c" of the third count cycle, the control is performed in the same manner. Namely, since the result of comparison between the heater temperatures TH0 and TH1 indicates that the heater temperature TH0 is lower (the temperature comparison result is an H level), the heaters HT0, HT1 and HT2 are assigned respectively to the sequence values "0", "1" and "2" in the same manner as in the first count cycle, i.e., "0"=HT0, "1"=HT1 and "2"=HT2. Thereafter, the heaters are controlled in order to successively energize one of the heaters corresponding to the sequence value.

In this manner, the temperature relation of the heaters is evaluated when the sequence counter 26 starts the count cycle in order to assign the heater having the lower temperature to the sequence value corresponding to the earlier output timing to heat it in an earlier timing, and therefore it is possible to decrease the differential temperature between the respective heaters, and enable efficient heating operation. Also, when the sequence value is counted up to the next sequence value, if the heater assigned to the next sequence value has already been reached the target temperature, this sequence value is skipped to output the further next sequence to energize and heat the heater assigned thereto, and therefore it is possible to shorten the energization delay of a heater, and enable efficient heating operation by avoiding the reduction in temperature.

While the target temperatures as set in the temperature comparing devices 15 and 25 are certain levels of temperature as the values RT0, RT1 and RT2 in the case of the above embodiment, the respective target temperatures can be given with predetermined widths. The mode register as described above can be used to determine whether each target temperature is given as a certain temperature level or as a temperature range designated by an upper limit and a lower limit. For example, a certain temperature level is set just after the image forming apparatus is powered up, and the control is switched in order that the target temperature is given as a temperature range during printing in a copy operation and so forth. When the target temperature is given as a temperature range, it is possible to decrease the number of times the heaters are turned on/off, which requires large current, and reduce the variation (ripple) of the power supply voltage in the image forming apparatus, resulting in a lower possibility of false operation of the image processing unit of the image forming apparatus.

Figure 7:
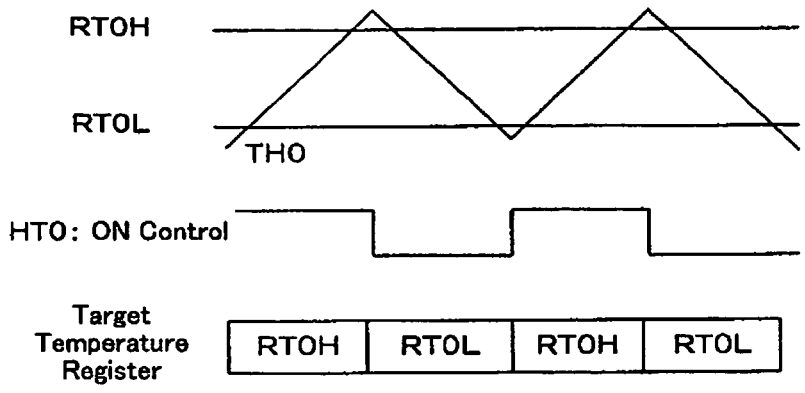
FIG. 7 is a timing chart for explaining the operation of a temperature comparing device for use in accordance with the present invention in which an upper limit target temperature and a lower limit target temperature are set.

In the case where the target temperature is given as a temperature range, an upper limit target temperature RT0H and a lower limit target temperature RTH0L are set for controlling the heater temperature (for example, TH0 in this case) as illustrated in FIG. 7. Then, the heater HT0 is turned on (energized) until the heater temperature TH0 reaches the upper limit target temperature, and when the upper limit target temperature is reached the heater HT0 is turned off while the target temperature is set to the lower limit target temperature RTH0L in the target temperature register.

Thereafter, the heater HT0 is maintained in its off-state until the heater temperature TH0 is lowered to or below the lower limit target temperature RTH0L. Namely, even if the sequence counter outputs the sequence value corresponding thereto ("0" in this case) before the heater temperature TH0 is lowered to the lower limit target temperature RTH0L, the heater HT0 is not turned on. In such a case, the sequence counter skips the sequence value to the next value. Then, when the heater temperature TH0 is lowered to the lower limit target temperature RTH0L, it become possible to turn on the corresponding heater HT0, and therefore when the sequence counter outputs the sequence value "0" corresponding thereto, the heater HT0 is turned on. At the same time, the target temperature is set to the upper limit target temperature RT0H in the target temperature resister.

Figure 8:
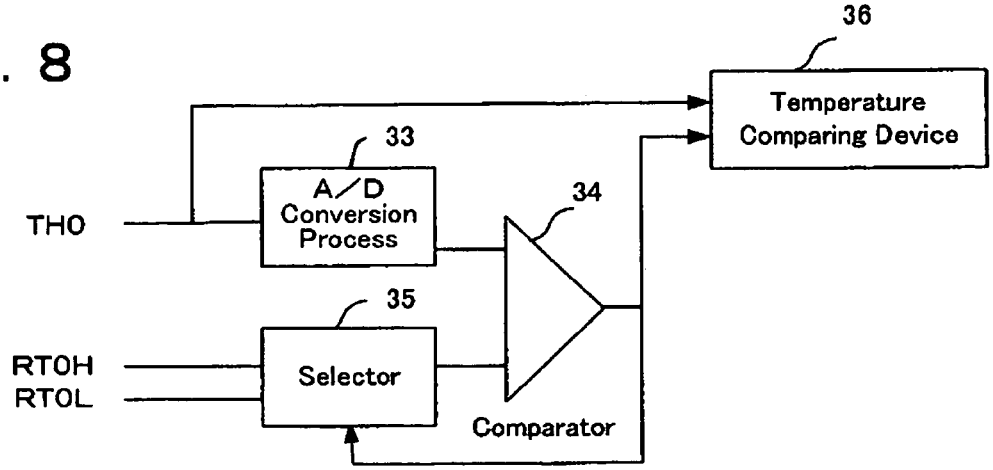
FIG. 8 is a circuit diagram showing the temperature comparing device for use in accordance with the present invention in which an upper limit target temperature and a lower limit target temperature are set.

The control circuit of switching the target temperature can be designed, for example, as illustrated in FIG. 8. The heater temperature (for example, TH0 in this case) is converted by an A/D (analog/digital) converter 33, and input to one terminal of a comparator 34. On the other hand, the upper limit target temperature RT0H and the lower limit target temperature RT0L are input to the selector 35 which selects and output one of them to the other terminal of the comparator 34. The comparator 34 compares the heater temperature TH0 to one of the target temperatures RT0H and RT0L, and outputs the result of comparison. This result of comparison is given to the selector 35 as a control signal for switching, and also given to the temperature comparing device 36 as the result of comparison to the target temperature together with the heater temperature TH0.

For example, when the heater temperature TH0 rises to or beyond the upper limit target temperature RT0H while the selector 35 selects the upper limit target temperature RT0H, the comparator 34 outputs an H level signal. This signal is input to the temperature comparing device 36 as information indicating that the heater temperature TH0 rises to or beyond the upper limit target temperature RT0H. Also, this H level signal is given also to the selector 35 which then selects the lower limit target temperature RT0L and output the temperature RT0L to the comparator 34.

When the heater temperature TH0 is lowered to or below the lower limit target temperature RT0L while the lower limit target temperature RT0L is selected, the comparator 34 outputs an L level signal. This signal is input to the temperature comparing device 36 as information indicating that the heater temperature TH0 is lowered to or below the lower limit target temperature RT0L. Also, this L level signal is given also to the selector 35 which then selects the upper limit target temperature RT0H and output the temperature RT0H to the comparator 34.

Meanwhile, the A/D converter 33, the comparator 34 and the selector 35 are provided for each of the heaters HT0, HT1 and HT2.

As has been discussed above, stable temperature control becomes possible by designating the target temperature as an temperature range.

Although exemplary embodiments of the present invention have been shown and described, it will be apparent to those having ordinary skill in the art that a number of changes, modifications, or alterations to the invention as described herein may be made, none of which depart from the spirit of the present invention. All such changes, modifications, and alterations should therefore be seen as within the scope of the present invention.

What is claimed is:

1. An image forming apparatus having a heating unit control function comprising:

a plurality of heating units each of which is configured to generate heat by energization;

a temperature measuring device configured to measure the temperatures of the heating units or an object to be heated by each of the heating units;

a sequence counter provided with a plurality of sequence values to which said plurality of heating units are assigned respectively, and configured to successively output the plurality of sequence values in an alternative manner as an instruction to energize the heating unit assigned to the sequence value as output such that, after the energization of the heating unit assigned to the sequence value as output is completed, the next sequence value is output;

a time counter configured to start counting the heating period of the heating unit assigned to the sequence value output from said sequence counter;

a temperature comparing device configured to compare a target temperature, which is set individually for each of the heating units or an object to be heated by each of the heating units, to the temperature of said each of the heating units or the object to be heated by said each of the heating units as measured by said temperature measuring device; and an energization control unit configured to energize the heating unit assigned to the sequence value as output from said sequence counter, halt the energization of the heating unit when the count of the heating period set for said heating unit is completed by said time counter, and halt the energization of the heating unit when said target temperature is reached by the temperature of said each of the heating units or the object to be heated by said each of the heating units even before the count of the heating period is completed by said time counter.

2. The image forming apparatus having a heating unit control function as claimed in claim 1 wherein the heating period of each heating unit is set individually on the basis of the temperature elevation characteristic of this heater in relation to the energization of the heating unit.

3. The image forming apparatus having a heating unit control function as claimed in claim 1 wherein the temperature comparing device is provided with, as a target temperature, an upper limit target temperature and a lower limit target temperature, and a target temperature switching unit is provided to change the target temperature to the upper limit target temperature when the temperature of a heating unit or the object to be heated by this heating unit is lowered to or below the lower limit target temperature, and to change a target temperature to the lower limit target temperature when the temperature of a heating unit or the object to be heated by this heating unit rises to or beyond the upper limit target temperature.

4. An image forming apparatus having a heating unit control function comprising:

a plurality of heating units each of which is configured to generate heat by energization;

a temperature measuring device configured to measure the temperatures of the heating units or an object to be heated by each of the heating units;

a sequence counter provided with a plurality of sequence values to which said plurality of heating units are assigned respectively, and configured to successively output the plurality of sequence values in an alternative manner as an instruction to energize the heating unit assigned to the sequence value as output such that, after the energization of the heating unit assigned to the sequence value as output is completed, the next sequence value is output;

a time counter configured to start counting the heating period of the heating unit assigned to the sequence value output from said sequence counter;

a temperature comparing device configured to compare a target temperature, which is set individually for each of the heating units or an object to be heated by each of the heating units, to the temperature of said each of the heating units or the object to be heated by said each of the heating units as measured by said temperature measuring device, and configured to compare the temperature of said each of the heating units or the object to be heated by said each of the heating units to each other;

a heating unit assignment unit configured to determine assignment of the heating units respectively to the sequence values of said sequence counter on the basis of the high/low relation in the temperatures of the heating units or the objects to be heated by the heating units as compared by said temperature comparing device; and an energization control unit configured to energize the heating unit assigned to the sequence value as output from said sequence counter, halt the energization of the heating unit when the count of the heating period set for said heating unit is completed by said time counter, and halt the energization of the heating unit when said target temperature is reached by the temperature of said each of the heating units or the object to be heated by said each of the heating units even before the count of the heating period is completed by said time counter.

5. The image forming apparatus having a heating unit control function as claimed in claim 4 wherein the heating period of each heating unit is set individually on the basis of the temperature elevation characteristic of this heater in relation to the energization of the heating unit.

6. The image forming apparatus having a heating unit control function as claimed in claim 4 wherein the temperature comparing unit is provided with, as a target temperature, an upper limit target temperature and a lower limit target temperature, and a target temperature switching unit is provided to change the target temperature to the upper limit target temperature when the temperature of a heating unit or the object to be heated by this heating unit is towered to or below the lower limit target temperature, and to change a target temperature to the lower limit target temperature when the temperature of a heating unit or the object to be heated by this heating unit rises to or beyond the upper limit target temperature.

7. The image forming apparatus having a heating unit control function as claimed in claim 4 wherein the heating unit assignment unit is configured to assign the heating unit having a lower temperature of the heating unit itself or a lower temperature of the object to be heated by the heating unit to the sequence value corresponding to an earlier output timing.

8. An image forming apparatus having a heating unit control function comprising:

a plurality of heating units each of which is configured to generate heat by energization;

a temperature measuring unit configured to measure the temperatures of the heating units or an object to be heated by each of the heating units;

a sequence counter provided with a plurality of sequence values to which said plurality of heating units are assigned respectively, and configured to successively output the plurality of sequence values in an alternative manner as an instruction to energize the heating unit assigned to the sequence value as output such that, after the energization of the heating unit assigned to the sequence value as output is completed, the next sequence value is output;

a time counter configured to start counting the heating period of the heating unit assigned to the sequence value output from said sequence counter;

a temperature comparing unit configured to compare a target temperature, which is set individually for each of the heating units or an object to be heated by each of the heating units, to the temperature of said each of the heating units or the object to be heated by said each of the heating units as measured by said temperature measuring unit;

an energization control unit configured to energize the heating unit assigned to the sequence value as output from said sequence counter, halt the energization of this heating unit after the count of the heating period set for this heating unit is completed by said time counter, and halt the energization of this heating unit when the target temperature corresponding thereto is reached by the temperature of this heating unit or the object to be heated by this heating unit even before the count of the heating period is completed by said time counter; and a skipping unit configured to skip a sequence value, which is to be output from said sequence counter when the energization of a heating unit is halted, in the case where the target temperature corresponding thereto has already been reached by the temperature of the heating unit assigned to this sequence value or the object to be heated by this heating unit, and let the next sequence value be output.

9. The image forming apparatus having a heating unit control function as claimed in claim 8 wherein the heating period of each heating unit is set individually on the basis of the temperature elevation characteristic of this heater in relation to the energization of the heating unit.

10. The image forming apparatus having a heating unit control function as claimed in claim 8 wherein the temperature comparing unit is provided with, as a target temperature, an upper limit target temperature and a lower limit target temperature, and a target temperature switching unit is provided to change the target temperature to the upper limit target temperature when the temperature of a heating unit or the object to be heated by this heating unit is lowered to or below the lower limit target temperature, and to change a target temperature to the lower limit target temperature when the temperature of a heating unit or the object to be heated by this heating unit rises to or beyond the upper limit target temperature.

11. The image forming apparatus having a heating unit control function of claim 1 wherein the sequence counter is further configured such that the alternative manner in which the plurality of sequence values is output occurs in a cyclically alternative manner.

12. The image forming apparatus having a heating unit control function of claim 4 wherein the sequence counter is further configured such that the alternative manner in which the plurality of sequence values is output occurs in a cyclically alternative manner.

13. The image forming apparatus having a heating unit control function of claim 8 wherein the sequence counter is further configured such that the alternative manner in which the plurality of sequence values is output occurs in a cyclically alternative manner.

14. A method for control of an image forming apparatus having a plurality of heating units, the method comprising:

energizing one of a plurality of heating units designated by a sequence value output by a sequence counter wherein the sequence counter further provides a plurality of sequence values to which said plurality of heating units are assigned respectively and outputs the plurality of sequence values in an alternative manner as an instruction to energize the heating unit assigned to the sequence value as output such that, after the energization of the heating unit assigned to the sequence value as output is completed, the next sequence value is output;

counting the heating period assigned to said heating unit;

halting the energization of said heating unit if said time counter finishes the heating period assigned to said heating unit;

halting the energization of said heating unit when a target temperature is reached by the temperature of said heating unit or the object to be heated by said heating unit even before the count of the heating period is completed by the time counter.

15. The method for control of an image forming apparatus having a plurality of heating units of claim 14 further comprising skipping the energization of a heating unit in the case where a target temperature, set specifically for that heating unit, has already been reached by the temperature of the heating unit.

* * * * *